United States Patent [19]

Ratz et al.

[11] 4,173,220

[45] Nov. 6, 1979

[54] FACEMASK

[75] Inventors: Thomas J. Ratz, Greenbelt; Ralph L. Baker, Baltimore, both of Md.

[73] Assignee: Midori Anzen Company, Ltd., Tokyo, Japan

[21] Appl. No.: 812,629

[22] Filed: Jul. 5, 1977

[30] Foreign Application Priority Data

Jul. 5, 1976 [JP] Japan ..... 51-88225

[51] Int. Cl.[2] ..... A62B 7/00

[52] U.S. Cl. ..... 128/142.7; 2/5; 2/6

[58] Field of Search ..... 128/142.7, 140 R, 141 R, 128/141 A, 142 R, 142.2, 142.3, 142.4, 142.5, 142.7, 145 R, 145 A, 147, 146 R, 146.3, 146.4, 146.5, 146.6, 146.7, 191 R, 195, 205, 188, DIG. 21; 2/5, 6, 411, 412, 2.1 R

[56] References Cited

U.S. PATENT DOCUMENTS

| | | | |
|---|---|---|---|
| 2,488,261 | 11/1949 | Bedini | 128/145 A X |
| 2,810,385 | 10/1957 | Reed | 128/142.7 |
| 3,238,943 | 3/1966 | Holley | 128/142.2 |
| 3,521,628 | 7/1970 | Piel | 128/142.5 |
| 3,572,332 | 3/1971 | Wise | 128/142.4 |
| 3,911,913 | 10/1975 | June | 128/142.5 |
| 3,962,519 | 6/1976 | Rusch et al. | 128/DIG. 21 |
| 4,019,508 | 4/1977 | Der Estephanian et al. | 128/142.5 X |

OTHER PUBLICATIONS

Braley, The Silicones as Tools in Biological Engineering, Jul. 1964, Med. Electron. Biol. Engin., vol. 3, pp. 127–136.

*Primary Examiner*—Henry J. Recla

*Attorney, Agent, or Firm*—Wenderoth, Lind & Ponack

[57] ABSTRACT

A facemask having a soft hood, a transparent eye piece, and a breathing mask forming an oro-nasal breathing chamber, all of which are integrally and uniformly secured to each other. The eye piece is flat and flexible, and when in use, forms a small space in front of the eyes isolated from the rest of the face and head. The breathing mask is provided with a voice disc and rapidly detachable couplings for breathing hoses. The soft, flexible hood is largely cut away at the ear portions where size adjustment bands are provided.

2 Claims, 2 Drawing Figures

FACEMASK

BACKGROUND OF THE INVENTION

This invention relates to a facemask, and in particular to a facemask for use in a closed circuit breathing system.

With a facemask for use in an open circuit breathing system, wherein a compressed air bottle is used as an air source and exhaled gas from the user is released from the facemask, it is not so difficult to prevent fogging of the eye piece of the facemask because the breathing air from the compressed air bottle may be directed across the eye piece to keep it clear.

However, in a facemask for use in a closed circuit breathing system, often adopted for a portable breathing apparatus, and wherein oxygen is supplied from a chemical oxygen generating apparatus or an oxygen cylinder, carbon dioxide gas is merely removed from the exhaled gas without venting the exhaled gas from the system. The carbon dioxide free exhaled gas is then mixed with fresh oxygen from the oxygen cylinder and is recirculated as breathing gas. Such a closed circuit facemask involves a large number of difficult technical problems. Above all, the most important problems are how to maintain the facemask airtight and to prevent fogging of the eye piece. That is, since a closed circuit facemask is intended to utilize oxygen generated from an oxygen supply source having a limited capacity as efficiently as possible, attention must be paid to the enhancement of the airtightness between the facemask and the face of the user so that no oxygen or breathing gas escapes from this area. However, with these completely closed facemasks, moisture gradually accumulates in the system due to the moisture contained in the exhaled gas and facial perspiration and condenses on the eye piece of the facemask, thereby fogging the eye piece.

Further, conventional facemasks, because of their large or protruding eye piece and/or full face seals, from an obstruction to the wearing of a helmet, such as a fireman's helmet. The facemask seal is often dislodged by the helmet, or the helmet does not fit properly over the facemask and its attachment, i.e. straps, buckles, etc.

Furthermore, most facemasks accommodate head size variations by employing straps and buckles across the back of the head and neck of the user which require adjustment. These straps and buckles are complicated to adjust. In many conventional applications, donning the facemask must be delayed until the breathing apparatus is actually used due to semi-permanent attachment of the breathing hoses to the facemask.

Also voice communication is generally hampered during use of the facemask since the mouth and nose, and sometimes the ears, are covered.

SUMMARY OF THE INVENTION

It is accordingly an object of the present invention to provide a facemask for use in a closed circuit breathing system in which fogging of the eye piece attached to the facemask is minimized.

It is another object of the present invention to provide a facemask for a closed circuit breathing system capable of being safely, easily and rapidly donned by a user.

It is still another object of the present invention to provide a closed circuit facemask capable of being comfortably donned by a user and which does not hamper the wearing of a helmet thereover.

It is still another object of the present invention to provide a closed circuit facemask capable of being quickly and easily connected to and disconnected from breathing hoses.

With the above object in view, a facemask according to the present invention comprises a flat and flexible transparent eye piece and a breathing mask forming an oro-nasal sealed breathing chamber both integrally and uniformly secured to a soft, flexible hood and closely fitting the user's cranium. The breathing mask is provided with a voice disc therein and breathing hose couplings which permit the breathing hoses to be rapidly detached therefrom. The soft hood has at both sides neck bands connected between the back and the lower jaw portion of the hood to adjust the facemask according to the size of the user's head.

BRIEF DESCRIPTION OF THE DRAWINGS

The present invention will become more readily apparent from the following detailed description of the preferred embodiment taken in conjunction with the accompanying drawings in which.

DETAILED DESCRIPTION OF THE PREFERRED EMBODIMENT

Figure 1:
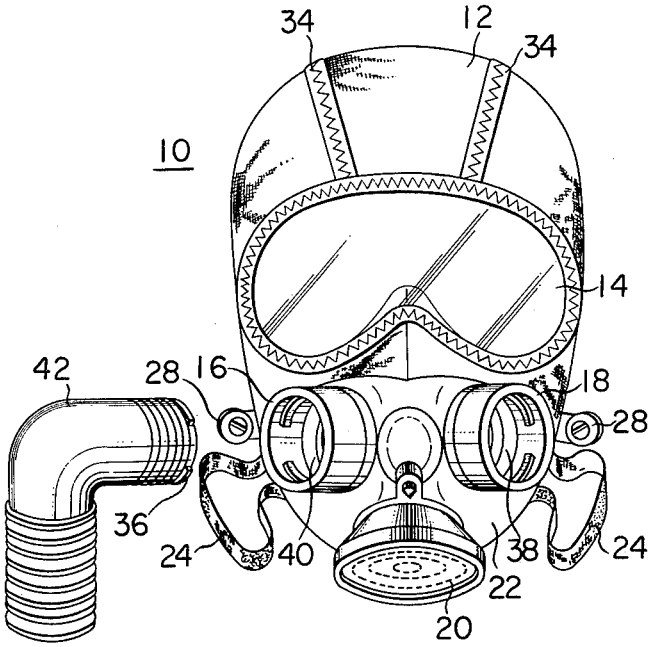
FIG. 1 is a front elevation of a facemask constructed in accordance with the present invention.
Figure 2:
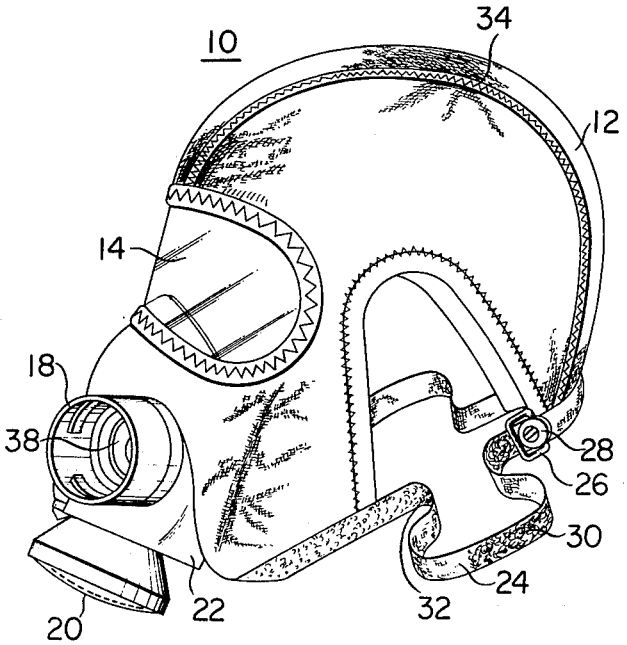
FIG. 2 is a side elevation of the facemask shown in FIG. 1.

Referring now to FIGS. 1 and 2, there is shown a facemask generally designated by the reference numeral 10 constructed in accordance with this invention. The facemask 10 includes a hood 12, an eye piece 14, and a breathing mask 22. The hood 12 is formed of a flexible material such as gas-impermeable foam neoprene rubber sheet with a closed cellular structure and having a thickness of about 3 mm. Each surface of the sheet is covered with nylon fabric and the sheet is formed into such a configuration as to closely fit a man's cranium in the same manner as the hood of a skin diver's wet suit. The large-sized eye piece 14 is secured to the hood 12 so that it forms an integral part of the hood 12 by taking advantage of the flexible properties of optically transparent, flexible polycarbonate sheeting so that the eye piece 14 does not protrude from the forehead of the hood 12, thus offering no obstruction to the front of the normally worn protective helmet. The breathing mask 22, which is one type of a mask in the narrow sense, is located below the eye piece 14, and has a coupling 16 for an inhalation hose 42, a coupling 18 for an exhalation hose (not shown) and a voice disc 20. The breathing mask 22 is formed of a flexible silicone rubber into a configuration which fits the face well so that the breathing mask 22 forms on airtight breathing chamber enveloping the oro-nasal area. The breathing mask 22 is secured to the hood 12 by means of an adhesive for example.

The facemask 10 further includes at both sides thereof inelastic size adjusting bands 24, one end of each of which is sewed into the lower jaw portion of the hood 12 and the other end of each of which is threaded through a ring buckle 26 fitted to the lower end of the back of the hood 12 and has a detachable bolt-nut type nylon ball attached thereto so as not to be pulled out of the buckle 26. The adjustable bands 24 are provided on the surfaces with fasteners in the form of loops 30 and hooks 32 opposed to each other for forming surface-to-surface fasteners. Therefore, the space between the back and the lower jaw portion of the hood 12 is substantially infinitely adjustable by firstly pulling the end of the adjustment band 24 at the nylon ball 28 toward the back of the hood 12 and then folding it back toward the fixed end of the adjustable band 24 to make fastened superpositions thereof.

When the facemask 10 is donned, the breathing mask 22 is supported and held to the face of the user by double supporting forces. One of the forces is applied along the line extending from the top of the breathing mask 22 through the eye piece 14 across the top of the hood 12 to the lower end of the back of the hood 12. This force is applied by means of non-extensible straps 34, which may be eliminated when the hood 12 is of a corresponding strength to the straps 34 extending and sewed from the top of the eye piece across the top and down the back of the hood 12. The other of the double supporting forces is applied along the line extending from the lower end of the breathing mask 22 to the lower end of the back of the hood 12 by means of the previously described adjustable bands 24. Thus, the breathing mask 22 is supported by a double supporting face system, ensuring an extremely good airtight fit between the breathing mask 22 and the face, thereby forming a hermetic oro-nasal breathing chamber enveloping the mouth and the nostrils of the user.

On the other hand, the position of eye piece 14 leaves a minimal space in front of the eyes and this space is isolated from the breathing chamber formed by the breathing mask 22 and from the forehead portion of the hood. Therefore fogging of the eye piece 14 due to accomulated moisture is minimized even after prolonged use of the facemask 10. Furthermore even if the fogging does take place on the inside face of the eye piece 14, the fact that the eye piece 14 is located in close proximity to the eyes causes the water-drops forming the fogging on the eye piece 14 to be out of focus to the eyes, resulting in minimal obstruction in viewing through the eye piece 14.

As set forth in the foregoing description and as seen from FIG. 2, the hood 12 is largely cut away at the portion corresponding to the user's ears in order not to cover the ears. Therefore, uncomfortable pressure will not occur at points on the ears even after long wear, and external voices and sounds can be heard as if no facemask were being worn. Also, even when the user wears special clothes, such as a fireman's suit, covering the whole body, the ambient temperature can be sensed via the exposed earlobes.

The inhalation coupling 16 and an exhalation coupling 18 have a well-known structure, in which a hose coupling 36 of an inhalation hose 42 and a hose coupling of the exhalation hose (not shown) can be fixedly coupled to the respective breathing mask couplings 16 and 18 by inserting the hoses into the coupling and rotating them a quarter of a complete rotation. These simple coupling mechanism for connecting and disconnecting the breathing hoses allow the breathing of ambient air with the breathing hoses disconnected even after the facemask 10 has been donned but before oxygen breathing is required. The inhalation and the exhalation couplings 16 and 18 have in the interior thereof check valves 38 and 40 respectively using a silicone rubber membrane to restrict the air flow to one direction for inhalation or exhalation. The voice disc 20 is formed of three metallic discs each provided with many holes of about 1 mm diameter and one piece of plastic film superposed therein with a small space or gap therebetween, thus enabling voice communications therethrough.

The facemask in accordance with the present invention is, constructed as previously explained, has many advantages over the prior art facemasks. These advantages include:

(1) The fogging of the eye piece is virtually prevented because the eye piece is isolated particularly from the breathing chamber;

(2) A good airtightness of the facemask can be obtained because of a soft, flexible and adjustable hood;

(3) The donning and adjustment of the facemask is extremely easy and can be completed in a short time, and in particular, with the facemask as above described, using the loop and hook fasteners for fastening the adjustment bands to the proper size, requires only one simple operation for supporting the facemask on the user's face;

(4) A helmet such as a fireman's hat can be comfortably worn on top of the facemask because the whole head portion of the facemask including the eye piece forms a low profile and is soft and flexible; and

(5) Very small amounts of carbon dioxide gas are accumulated in the breathing chamber because the check valves are positioned adjacent to the nostrils, making the dead volume of the breathing chamber extremely small.

What is claimed is:

1. A facemask for use in a closed circuit breathing system comprising:

a soft, flexible hood for closely covering the head of a user and having a cut-away portion at opposite side positions corresponding to the user's ears for exposing the user's ears when the facemask is worn;

a transparent flexible eye piece secured to said hood for allowing the user to see therethrough, said eye piece being substantially flush with the hood for forming a continuous, low profile contour with said hood;

a breathing mask secured to said hood and including means adapted to hermetically envelope the mouth and the nostrils of the user when the facemask is worn by the user for forming a closed breathing chamber between said breathing mask and the facial skin of the user, said breathing mask having means for connecting breathing hoses to said breathing mask for directly flow of breathing gas directly into and out of said breathing mask, a voice disc on said breathing mask for allowing voice communications by the user, and check valve means in said means for connecting breathing hoses for regulating the direction of flow of the inhalation and exhalation gases to and from said breathing chamber; and supporting means constituting part of said hood for firmly supporting said breathing mask on the oro-nasal portion of the user's face and constituted by inelastic straps integrally attached to said hood and extending across the top and down the back of said hood, and inelastic adjusting bands connected across said cut-away portion of said hood adjacent the lower edges of said hood and means for adjusting said bands to adjustably secure the hood to the head of a user.

2. A facemask as claimed in claim 1, wherein said adjusting means includes a ring buckle fitted to each side of the lower end of the back thereof, and said adjusting bands have opposed loop and hook fastening means thereon, one end of each of said adjusting bands being secured to the portion of said hood adjacent the lower jaw of the user and the other end of each of said adjusting bands being threaded through the corresponding ring buckle.

* * * * *